US011333361B2

(12) United States Patent
Jangid

(10) Patent No.: US 11,333,361 B2
(45) Date of Patent: May 17, 2022

(54) COMBUSTOR LINER FLEXIBLE SUPPORT AND METHOD

(71) Applicant: Nuovo Pignone Srl, Florence (IT)

(72) Inventor: Biharilal Jangid, Bangalore (IN)

(73) Assignee: NUOVO PIGNONE SRL, Florence (IT)

( * ) Notice: Subject to any disclaimer, the term of this patent is extended or adjusted under 35 U.S.C. 154(b) by 672 days.

(21) Appl. No.: 15/536,224

(22) PCT Filed: Nov. 30, 2015

(86) PCT No.: PCT/EP2015/078086
§ 371 (c)(1),
(2) Date: Jun. 15, 2017

(87) PCT Pub. No.: WO2016/096388
PCT Pub. Date: Jun. 23, 2016

(65) Prior Publication Data

US 2017/0350599 A1 Dec. 7, 2017

(30) Foreign Application Priority Data

Dec. 15, 2014 (IT) ..... FI2014A0293

(51) Int. Cl.
*F23R 3/60* (2006.01)
*F23R 3/48* (2006.01)
*F23R 3/00* (2006.01)

(52) U.S. Cl.
CPC ..... *F23R 3/48* (2013.01); *F23R 3/002* (2013.01); *F23R 3/60* (2013.01); *F23R 2900/00014* (2013.01); *F23R 2900/00017* (2013.01)

(58) Field of Classification Search
CPC .... F23R 3/50; F23R 3/60; F23R 3/002; F23R 2900/00017; F23R 2900/00018; F23R 2900/00013; F23R 2900/00014
See application file for complete search history.

(56) References Cited

U.S. PATENT DOCUMENTS 4,008,568 A 2/1977 Spears, Jr. et al.
4,030,875 A 6/1977 Grondahl et al.
(Continued)

FOREIGN PATENT DOCUMENTS

CN 1506617 A 6/2004
EP 1 096 207 A1 5/2001
(Continued)

OTHER PUBLICATIONS

Italian Search Report and Written Opinion issued in connection with corresponding IT Application No. IT FI20140293 dated Aug. 7, 2015.
(Continued)

*Primary Examiner* — Todd E Manahan
*Assistant Examiner* — Thuyhang N Nguyen
(74) *Attorney, Agent, or Firm* — Baker Hughes Patent Org.

(57) ABSTRACT

A combustor for a gas turbine is described. The combustor comprises a combustor liner, a metering plate attached to an end of the combustor liner and a combustor casing at least partially surrounding the combustor liner. An end cover is further connected to the combustor casing. The combustor liner is connected to the combustor casing by means of a retainer arranged between the metering plate and the end cover, and attached to the metering plate and to the end cover.

12 Claims, 7 Drawing Sheets

(56) References Cited

U.S. PATENT DOCUMENTS

| | | | | |
|---|---|---|---|---|
| 4,454,711 | A * | 6/1984 | Ben-Porat | F23R 3/10 60/748 |
| 6,199,367 | B1 * | 3/2001 | Howell | F23D 11/24 239/402.5 |
| 6,279,323 | B1 | 8/2001 | Monty et al. | |
| 6,453,675 | B1 * | 9/2002 | Royle | F23R 3/007 60/800 |
| 6,912,782 | B2 | 7/2005 | Nguyen et al. | |
| 7,322,196 | B2 | 1/2008 | Tiemann | |
| 7,617,689 | B2 * | 11/2009 | Schumacher | F02C 7/20 239/399 |
| 2004/0200069 | A1 | 10/2004 | Nguyen et al. | |
| 2012/0047909 | A1 | 3/2012 | Ghanime | |

FOREIGN PATENT DOCUMENTS

| | | | | |
|---|---|---|---|---|
| EP | 1096207 | A1 * | 5/2001 | F23R 3/007 |
| EP | 1 096 207 | B1 | 12/2006 | |
| JP | S5659131 | A | 5/1981 | |
| JP | S584811 | A | 1/1983 | |
| JP | S59113663 | U | 8/1984 | |
| JP | 62-35954 | U | 3/1987 | |
| JP | S6235954 | U | 3/1987 | |
| JP | S634690 | A | 1/1988 | |
| JP | S63143730 | U | 9/1988 | |
| JP | H01-111148 | U | 7/1989 | |
| JP | H02197718 | A | 8/1990 | |
| JP | H05-118549 | A | 5/1993 | |
| JP | 2006010113 | A | 1/2006 | |
| JP | 2009002535 | A | 1/2009 | |

OTHER PUBLICATIONS

International Search Report and Written Opinion issued in connection with corresponding PCT Application No. PCT/EP2015/078086 dated Feb. 22, 2016.

International Preliminary Report on Patentability issued in connection with corresponding PCT Application No. PCT/EP2015/078086 dated Jun. 20, 2017.

Machine Translation and First office action and Search issued in connection with corresponding CN Application No. 201580068601.9 dated Jan. 23, 2019.

* cited by examiner 1
3
5
5A
7
7A
11
13
17
21
23
25
27
29
41
41A
43
51

COMBUSTOR LINER FLEXIBLE SUPPORT AND METHOD

BACKGROUND

The embodiments of the subject matter disclosed herein generally relate to improvements to gas turbine combustors.

Gas turbines typically include a compressor section, a combustor section, and a turbine section. The compressor section pressurizes air flowing into the gas turbine. The pressurized air discharged from the compressor section flows into the combustor section, which is generally comprised of a plurality of combustors disposed around an annular array about the axis of the gas turbine. Each of the plurality of combustors includes a combustor liner, which defines the combustion chamber of the combustor. Air entering each combustor is mixed with fuel and burnt within the combustor liner. Hot combustion gases flow from the combustor liner through a transition piece to the turbine section of the gas turbine to drive the turbine and generate mechanical power.

The combustor liner is typically concentrically located within a combustor casing and radially inwardly spaced therefrom. The combustor casing can comprise a flow sleeve. An annular air flow passage is defined between the combustor casing and the combustor liner. Compressed air flows through the air flow passage and enters the combustor liner through metering apertures provided therein and usually located in a metering plate which closes the combustion chamber at the forward end thereof.

According to some known arrangements, in order to mount the combustor liner in the combustor casing, the forward end of the combustor liner is provided with a plurality of circumferentially spaced liner stops, which engage and/or mate with a corresponding number of liner guide stops typically secured to the combustor casing. As such, when the combustor liner is installed within the combustor casing, the liner stops ensure proper radial and axial location of the combustor liner within the combustor casing and also prevent the combustor liner from moving in an axially downstream direction (i.e., towards the transition piece).

During operation, combustor dynamics and thermal stresses may cause the combustor liner, the combustor casing and other components of the combustor to vibrate and otherwise move with respect to one another. This can lead to failure of the liner stops and/or the liner guide stops, thereby resulting in misalignment of the combustor liner within the combustor casing and/or damage to the combustor liner or combustor casing.

More specifically, combustors are typically designed such that they can freely thermally expand in radial as well as axial direction, to meet durability requirements. Hence, a combustor assembly is comprised of many components which are in mutual sliding contact, such as liner stops and casing stops, hula seals, cross fire tubes and collars, fuel burners and swirler collar, etc. During operation, hardware is subjected to vibratory loads such pressure oscillations due to combustion dynamics, rotor imbalance and the like. These vibratory loads cause the combustor to vibrate, which results in relative movement at the sliding interfaces. Relative movement combined with high contact load at interface (due to misalignment in assembly, for instance) cause material loss due to wear out, which could progress further and lead unscheduled outage.

In order to repair the damaged liner guide stops, the combustor must be taken offline and at least partially disassembled. The combustor liner and/or the combustor casing have to be removed and a worker must machine the damaged component on site, or send the parts off-site for repair resulting in costly repairs and extended outage periods.

In an attempt to at least alleviate the drawbacks of the above described known mounting systems, according to other known arrangements the combustor liner is supported in the combustor casing by means of an annular retainer located around the combustor liner, between the latter and the combustor casing. The annular retainer has resilient properties to limit the relative motions between components of the combustor. The retainer is also made in such a way that offers a compact solution.

FIG. 1 illustrates an embodiment of this known arrangement. A combustor 400 comprises a combustor liner 404 arranged substantially concentrically in a combustor casing 406. The combustor liner has a first, forward end 404A connected to the combustor casing 406 and a second, backward end 404B connected to a transition piece 405, which extends towards a turbine wheel, not shown. Combustion gases are conveyed by the transition piece 405 from the combustor towards the turbine wheel, where they expand generating mechanical power made available on the turbine shaft. The first end 404A of the combustor liner 404 is attached to a retainer 402. The retainer 402 encircles the first end 404A of the combustor liner 404. The retainer 402 is attached to the combustor casing 406 and configured to act as a spring between the combustor liner 404 and the combustor casing 406.

More specifically, the retainer 402 is comprised of: a section 408 for attaching to the outside of the combustor liner 404, a spring-like section 410 and a section 412 for attaching to the combustor casing 406. The section 412 is sandwiched between a flange section 414 of the combustor casing 406 and an. A so-called cross-fire tube 416 projecting from the liner 404 connects the liner of one combustor to the liner to the adjacent combustor. The cross-fire tubes allow hot combustion products from one combustor to travel through the cross-fire tube to provide an ignition source in the adjacent combustor. Cross-fire tubes extend from one liner to the adjacent one, extending across the respective combustor casings.

A burner 418 is supported at the end plate 416. High-pressure combustion air A delivered by the compressor of the gas turbine (not shown) flows through an annular flow passage between the combustor liner 404 and the combustor casing 406, or a flow sleeve connected thereto and enters the combustion chamber bounded by the combustor liner 404 through holes in a metering plate 420. Through burner 418 fuel is delivered in the combustion chamber and burns with the air, generating combustion gases which flow into the turbine through the transition piece 405.

The retainer 402 provided effective isolation of vibratory movements. However, there is still room for improvements, in particular as far as easiness of manufacturing and assembling, as well as reduction of heat loads and thermal expansion differentials are concerned.

Accordingly, an improved system for connecting the combustor liner to the combustor casing and a method for installing the combustor liner to the combustor casing are desirable.

SUMMARY OF THE INVENTION

Disclosed herein is a combustor for a gas turbine, comprising a combustor liner having a side wall surrounding a burning chamber and at least partly surrounded by a combustor casing. At one end of the combustor liner a metering plate is attached. An end cover is connected to the combustor casing. A retainer is further provided, which connects the combustor liner to the combustor casing. The retainer is arranged between the metering plate and the end cover, and is attached to the metering plate and to the end cover. The combustor liner is thus supported in a substantially co-axial position in the combustor casing. Both the combustor casing and the combustor liner can have a substantially cylindrical shape with a generally circular cross-section.

The retainer is thus located behind the combustor liner, between the metering plate thereof and the end cover which closes the combustor casing. The space between the combustor casing and the combustor liner can thus be substantially free of any retainer members.

In some embodiments the retainer comprises at least one elastic arrangement positioned between the metering plate and the end cover. The elastic arrangement can be comprised of one or more resilient or elastic members. In some embodiments flexurally deformable springs, such as leaf springs can be used as elastic members. Exemplary embodiments comprise Belleville springs or washers as elastic members.

The retainer can be provided with one or more sets of resilient members, variously arranged between the metering plate and the end cover. In some embodiments, the members of the elastic arrangement are in surface contact with the end cover.

In some embodiments the retainer comprises a first ring element constrained to the metering plate and a second ring element arranged between the first ring element and the end cover.

Disclosed herein is also a method for mounting a combustor liner in a combustor casing of a gas turbine combustor. In an embodiment the method comprises the following steps: providing a combustor liner and a metering plate attachable to the combustor liner; providing a combustor casing; providing an end cover attachable to an end of the combustor casing; attaching a metering plate of a combustor liner to a retainer; introducing the combustor liner in the combustor casing; attaching the retainer to the end cover and to the metering plate; connecting the end cover to the combustor casing, such that the combustor liner is supported approximately concentrically in the combustor casing.

Features and embodiments are disclosed here below and are further set forth in the appended claims, which form an integral part of the present description. The above brief description sets forth features of the various embodiments of the present invention in order that the detailed description that follows may be better understood and in order that the present contributions to the art may be better appreciated. There are, of course, other features of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION OF EMBODIMENTS

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

Figure 1:
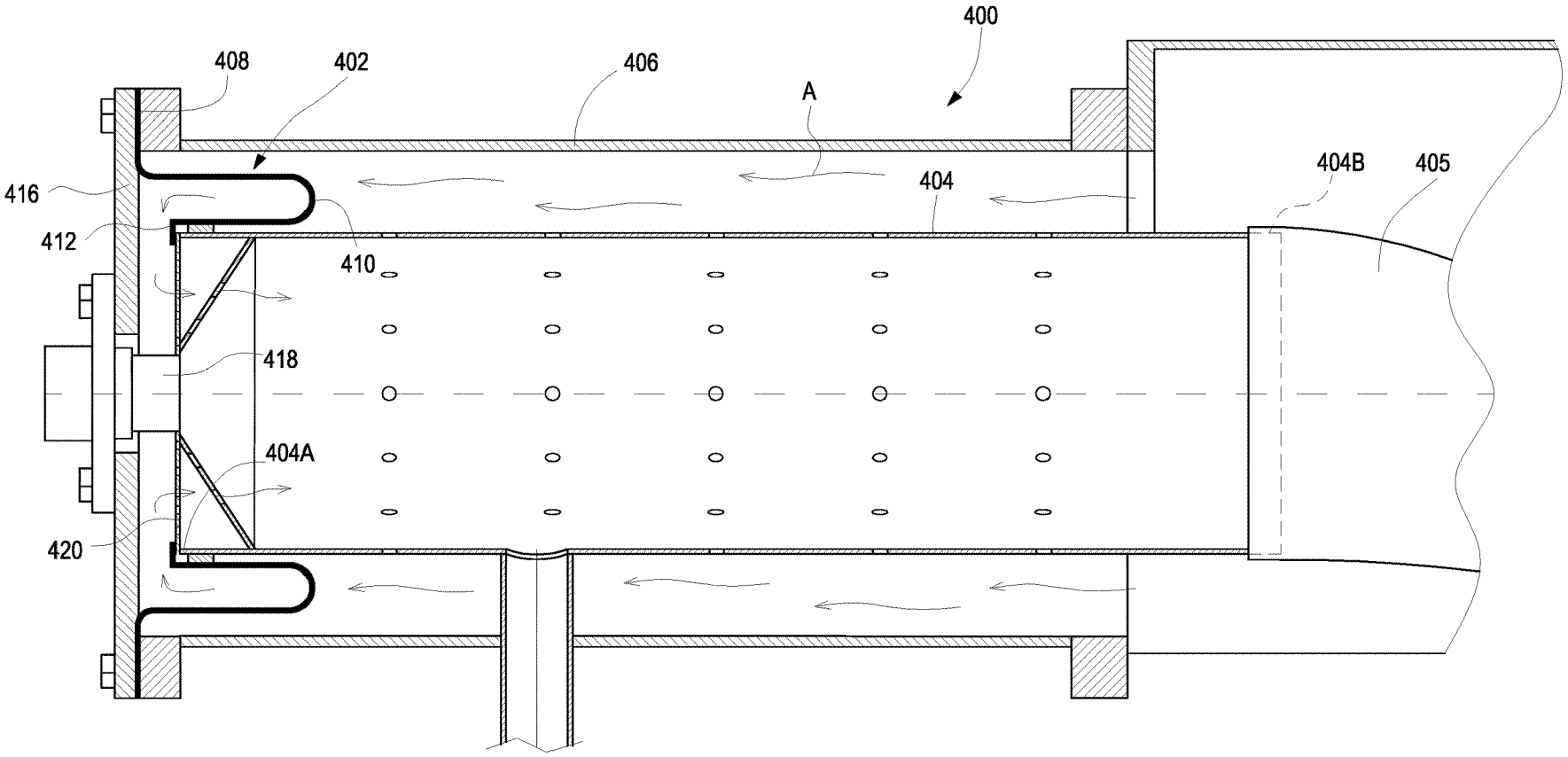
Fig.1 BACKGROUND ART
FIG. 1 illustrates a schematic sectional view of a combustor of a gas turbine according to the current art.
Figure 2:
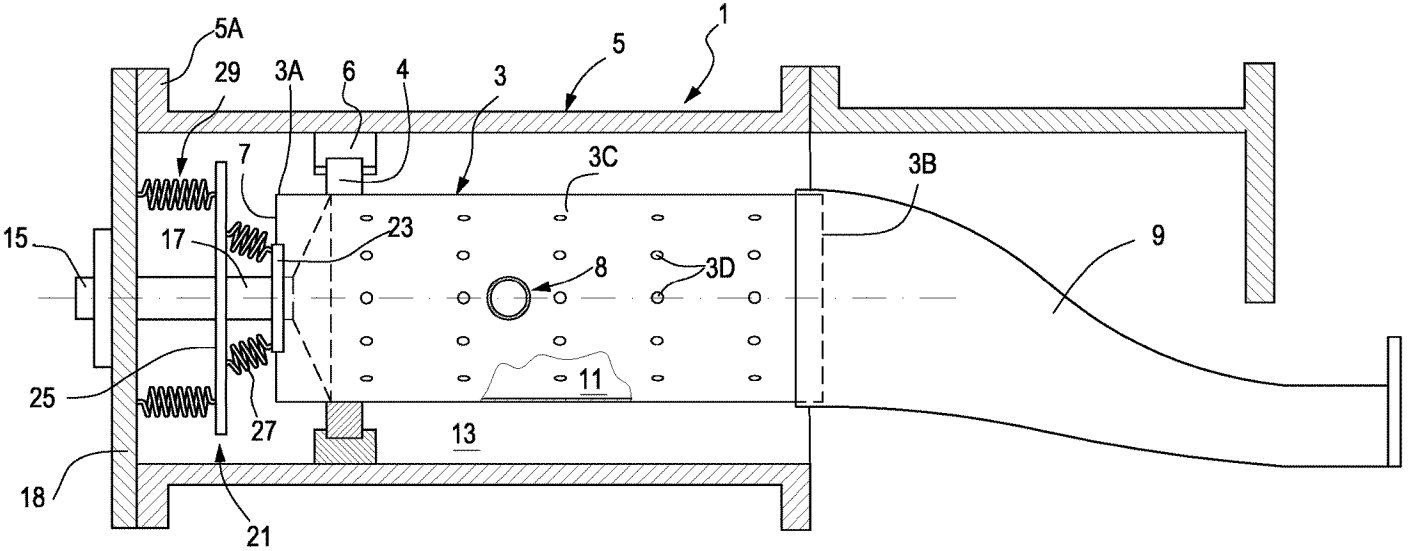
FIG. 2 illustrates a schematic sectional view illustrating the main functional elements of a combustor and relevant elastic liner mounting system according to the subject matter disclosed herein.

FIG. 2 illustrates a schematic sectional view of a combustor according to the subject matter disclosed herein. The section is taken along a plane containing the axis of the combustor chamber. The combustor 1 comprises a combustor liner 3 and a combustor casing 5. The combustor liner 3 is at least partially supported within the combustor casing 5. The combustor liner 3 and the combustor casing 5 are substantially concentric to one another. The combustor casing 5 can be comprised of a flow sleeve, not shown in detail.

The combustor liner 3 has a first end 3A, a second end 3B and a side wall 3C extending therebetween. A metering plate 7 is arranged at the first end 3A of the combustor liner 3. A transition piece 9 extends from the second end 3B of the combustor liner 3 towards a power turbine, not shown, to deliver compressed combustion gases thereto.

Figures 7, 8, 9:
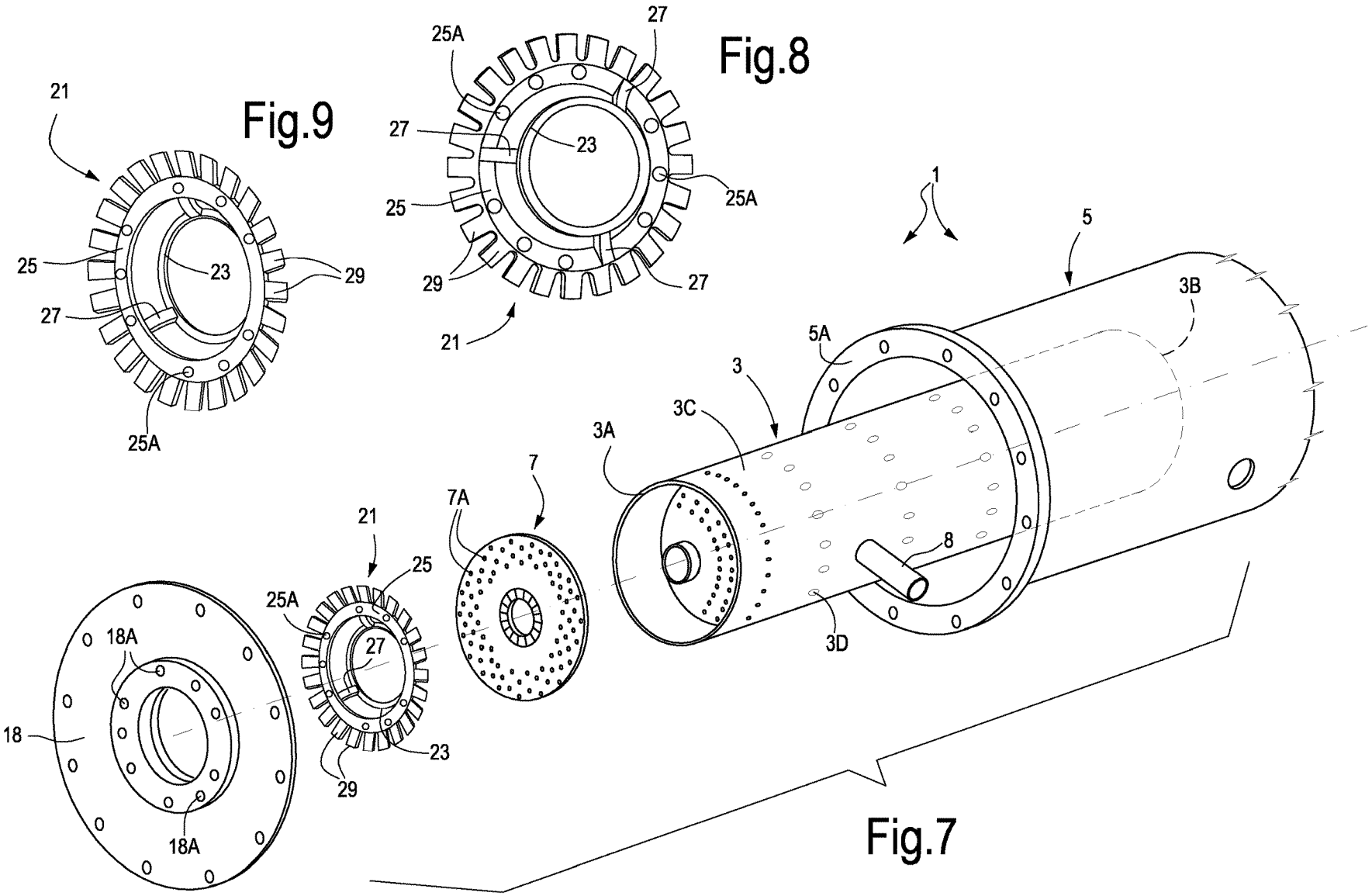
FIG. 7 illustrates an exploded view of the main components of the combustor according to FIG. 6.
FIGS. 8 and 9 illustrate axonometric views of the retainer of FIGS. 6 and 7.

A combustion chamber 11 is defined in the interior of the combustor liner 3. Air provided by a compressor, not shown, is delivered to the combustion chamber 11 through an annular flow passage 13 formed between the combustor liner 3 and the combustor casing 5. Air enters the combustion chamber 11 through metering apertures or holes 7A provided in the metering plate 7 (see FIG. 7) and through auxiliary holes 3D provided in the side wall 3C.

A fuel nozzle 15 provides gaseous or liquid fuel to a burner 17. The fuel is mixed with the combustion air entering the combustion chamber 11 through the metering apertures or holes 7A of the metering plate 7. The air/fuel mixture burns generating hot, compressed combustion gas, which flows into the power turbine through the transition piece 9 and expands in the power turbine, which converts part of the pressure and thermal energy of the combustion gas into mechanical power available on the turbine shaft.

A retainer 21 is attached to the metering plate 7 and connects the combustor liner 3 to an end cover 18. The end cover 18 is in turn attached to a first end 5A of the combustor casing 5. More specifically, the retainer 21 is arranged between the metering plate 7 and the end cover 18. The end plate 18 closes the combustor casing 5 at the end opposite the power turbine wheel, not shown, i.e. opposite the transition piece 9.

According to some embodiments the retainer 21 is attached to the metering plate in surface portion(s) thereof, which are devoid of metering holes, as will be detailed later on.

The retainer 21 can provide a resilient connection between the metering plate 7 and the end cover 18, such as to provide a flexible support of the combustor liner 3 on the end cover 18, which is in turn connected to the combustor casing 5. The retainer 21 can be shaped in several different ways, and some possible embodiments thereof will be described in greater detail later on.

In some embodiments, the retainer 21 comprises a first ring element 23 and a second ring element 25. The first ring element 23 is constrained to the metering plate 7 and the second ring element 25 is connected to the first ring element 23 and to the end cover 18.

In some embodiments, the metering plate 7 and the retainer 21 are connected to one another in an irreversible manner, e.g. the first ring element 23 can be soldered, brazed or welded to the surface of the metering plate 7 facing the end cover 18. In other embodiments, connection between the metering plate 7 and the retainer 21 can be obtained by disconnectable members, e.g. bolts and/or screws. In some embodiments, the retainer 21 can be riveted to metering plate 7.

The retainer 21 can be designed to mount the combustion liner 3 in a centered position with respect to the fuel nozzle of burner 17, the end cover 18 as well as the combustor casing 5. Additionally, the retainer 21 can have a predetermined axial and radial stiffness to obtain a desired natural frequency of the combustor assembly, which is distant from, vibratory forcing function frequencies thus avoiding a resonance condition. Relative motion due to vibration at the various sliding interfaces in the combustor assembly is thus reduced.

To provide flexibility to the combustor liner support, the retainer 21 can be comprised of an elastic arrangement, which is positioned intermediate the metering plate 7 and the end cover 18.

In the schematic representation of FIG. 2, the elastic arrangement is schematically represented as a first set of connector elements 27 in the form of resilient members 27, located between the first ring 23 and the second ring 25, and a second set of connector elements in the form of resilient members 29 located between the second ring element 25 and the end cover 18. The resilient members 27 and/or 29 can be pre-loaded against the end cover 8 to provide frictional damping effect, as will be disclosed in greater detail here below, reference being made to some embodiments.

As will become clear from the following description of exemplary embodiments, in some configurations only the first set of resilient members 27, or only the second set of resilient members 29 can be provided. In yet further embodiments, rigid connector elements 27 and/or 29 can be used, rather than resilient members, as will be described later on.

Figure 3:
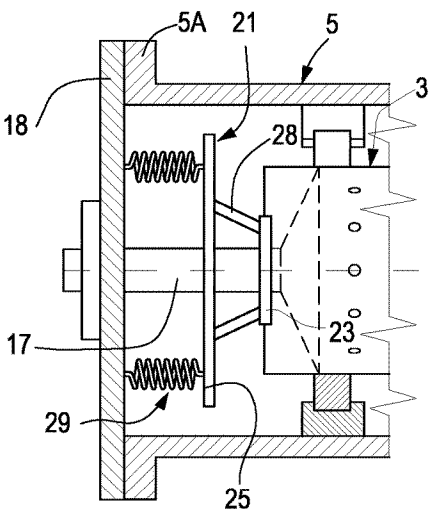

For instance, FIG. 3 schematically illustrates a configuration wherein the resilient members 27 of the first set of resilient members are replaced by rigid connectors 28 and the elastic arrangement only comprises the second set of resilient members 29 between the second ring element 25 and the end cover 18. The rigid connectors 28 can have any suitable shape, resulting in easy manufacturing and assembling.

Figure 4:
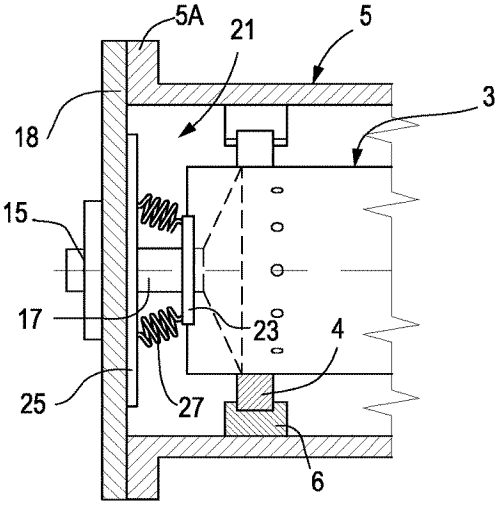
FIGS. 3, 4 and 5 are schematic representations of modified embodiments of the elastic mounting system for connecting the combustor liner to the combustor casing.

FIG. 4 schematically illustrates a configuration, wherein the resilient members 29 of the second set of resilient members are omitted, the second ring element 25 is rigidly connected to the end cover 18 and resilient members 27 of the first set of resilient members are provided only between the first ring element 23 and the second ring element 25.

Figure 5:
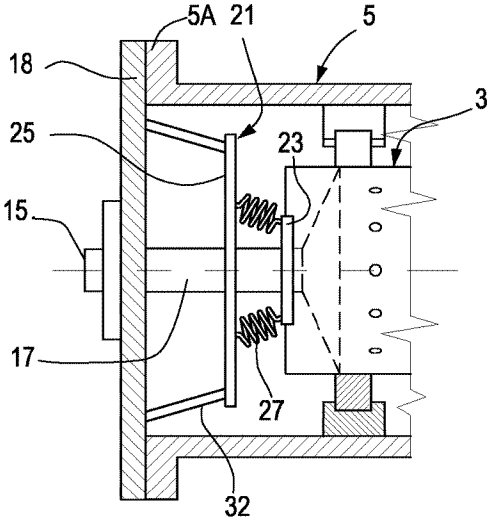

FIG. 5 schematically illustrates a configuration, wherein resilient members 27 are provided between the first ring element 23 and the second ring element 25, but not between the second ring element 25 and the end cover 18. Rigid connectors 32 are provided for connecting the second ring element 25 and the end cover 18.

FIGS. 6 to 10 illustrate details of exemplary embodiments of the combustor including first and second set of resilient members 27 and 29, respectively between the first and second ring elements 23, 25 and between the second ring element 25 and the end cover 18.

As best shown in FIGS. 7, 8, 9 and 10, the retainer 21 is comprised of a first ring element 23, which can be directly constrained to the metering plate 7 of the combustor liner 3. The first ring element 23 can contact the external surface of the metering plate 7, in an area thereof which is devoid of metering apertures or holes 7A.

The first ring element 23 can be connected to the second ring element 25 by means of a plurality of first resilient members 27, forming part of the elastic arrangement. In the exemplary embodiment illustrated in FIGS. 7 to 9, the first set of resilient members can comprise three resilient members 27, which can be arranged according to a constant angular pitch, i.e. at about 120° one from the other. In other embodiments the first set of resilient members 27 can comprise a different number of resilient members, e.g. four, five, six or more such resilient members 27 can be in an embodiment distributed at a constant angular pitch around the axis of the liner 3.

The first resilient members 27 can be in the form of curved, flexurally deformable connectors, having a first end constrained to the first ring element 23 and a second end constrained to the second ring element 25. The resilient members 27 can be manufactured as separate components and subsequently welded, soldered or brazed at opposite ends thereof to the first ring element 23 and second ring element 25. In other embodiments, the resilient members 27 can be manufactured integrally with the first ring element 23 or with the second ring element 25 and soldered, welded or brazed to the second ring element or the first ring element. In yet further embodiments, the resilient members 27 can be integrally manufactured with the first ring element 23 and second ring element 25.

Providing the resilient members 27 as separate components which are subsequently attached to the ring elements 23, 25 allows more freedom in the selection of materials and/or cross-sectional shapes of the components 23, 25, 27, such that optimal mechanical resistance and resilient characteristics can be imparted to the various parts of the retainer 21, as needed.

The second ring element 25 can be connected to the end cover 18 for instance in a manner which allows demounting thereof, i.e. in a reversible manner. According to some embodiments, the second ring element 25 can be connected to the end cover 18 by means of bolts 41 and nuts 41A. The bolts 41 can extend through holes 25A provided in the second ring element 25 and can be locked on the end cover 18 by means of nuts 41A. According to other embodiments, the bolts 41 can be welded to the second ring element 25.

Stably connecting the bolts 41 to the second ring element 25, e.g. by welding, makes assembling of the combustor liner 3 into the combustor casing 5 easier. Indeed, the retainer 21 including the bolts 41 that extend backwards from the second ring element 25 and the metering plate 7 can be mounted on the combustor liner 3. The latter is then introduced into the combustor casing 5 and the bolts 41 can be introduced through the holes 18A of the end cover 18. The sub-assembly formed by the retainer 21 and the combustor liner 3 connected thereto is finally screwed against the inner surface of the end cover 18 by means of nuts 41A.

Figure 6:
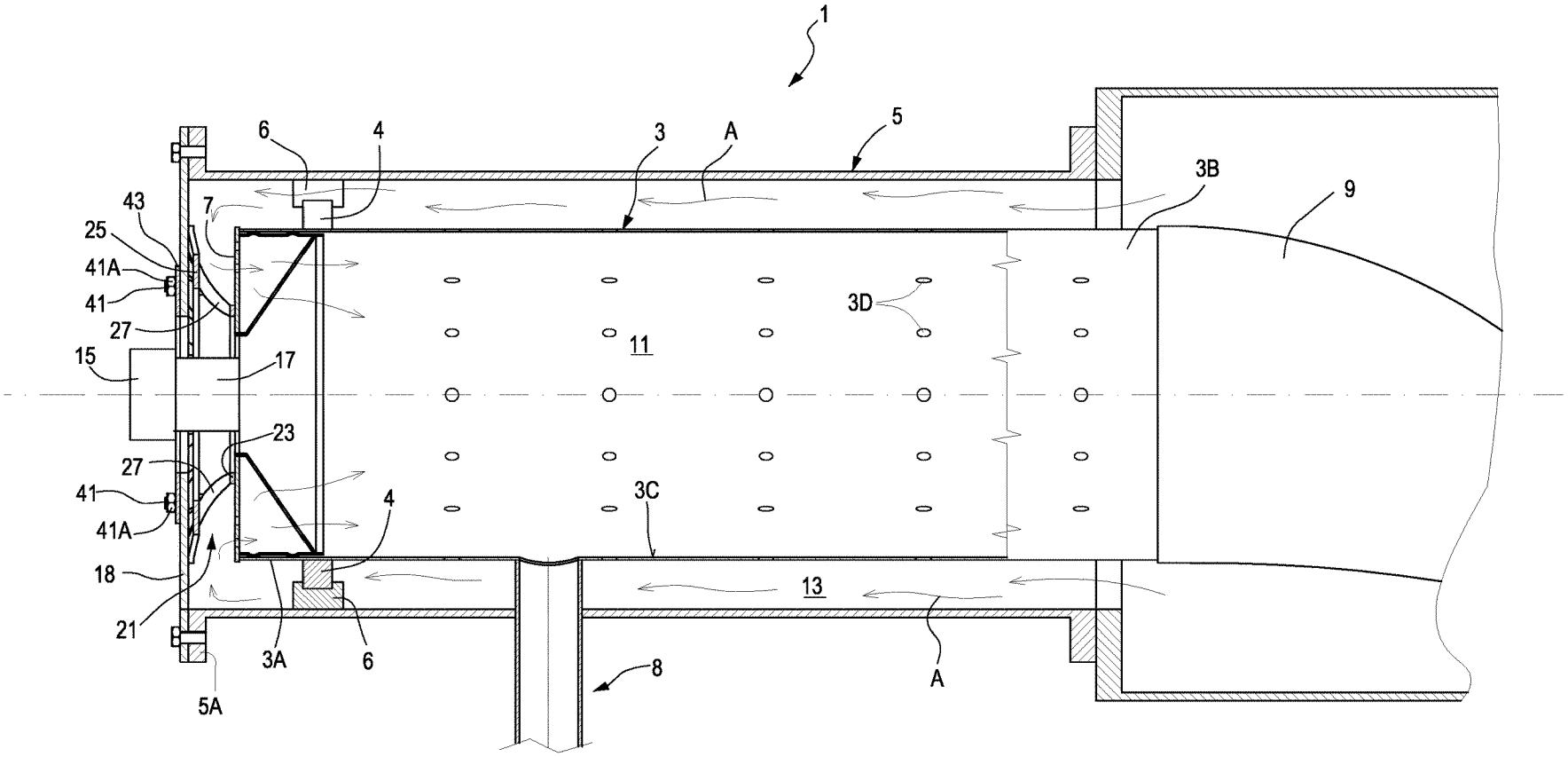
FIG. 6 illustrates a sectional view of an exemplary embodiment of a combustor according to the subject matter disclosed herein.

According to some embodiments, the combustor liner 3 can be provided with two or more liner stops 4 (see FIG. 6) arranged on the outer surface thereof and co-acting with casing stops 6, mounted on the inner surface of the combustor casing 5. These stops can be used as temporary retainer means for the combustor liner 3 in the combustor casing 5, e.g. in order to make mounting of cross-fire tubes easier. In FIG. 6 a portion of a cross-fire tube 8 is schematically shown, extending from the combustor liner 3 through the combustor casing 5 towards an adjacent combustor (not shown). The combustor liner 3 can be provisionally mounted inside combustor casing 5 and supported therein by means of the stops 4 and 6, allowing manual assembling of the cross-fire tubes 8. This operation is made easier by the retainer 21 being located behind the metering plate 7 and leaving free access to the annular space between the combustor casing 5 and the combustor liner 3. Once the cross-fire tubes 8 have been mounted, the end cover 18 can be assembled.

An annular sealing gasket 43 can be provided between the nuts 41A and the outer surface of the end cover 18, to prevent air leakages through bolt holes 18A in the end cover 18. A housing around bolts 41 and nuts 41A can be arranged, in combination to the sealing gasket or as an alternative thereto, on the outer surface of end cover 18, to reduce or prevent air leakage.

In some embodiments the second set of resilient members 29 can be comprised of resilient leaves 29 radially projecting from the second ring element 25. The resilient leaves 29 can be inclined from the second ring element 25 towards the end cover 18 and can rest with distal ends thereof against the inner surface of the end cover 18. The resilient leaves 29 can be formed monolithically with the second annular element 25. According to other embodiments, the resilient leaves 29 can be welded or soldered to the second ring element 25.

When the retainer 21 is constrained to the end cover 18, by screwing the nuts 41A on bolts 41 the second ring element 25 is moved towards the end cover 18 and the resilient leaves 29 are pressed against the inner surface of the end cover 18, causing a flexural deformation of the resilient leaves 29. By screwing the bolt-nut connections 41, 4A the resilient leaves 29 can thus be elastically pre-loaded. Friction is thus generated at the area of contact between the resilient leaves 29 and the inner surface of the end cover 18. Movement of the retainer 21 with respect to the end cover 18 caused e.g. by vibration of the combustor will generate friction losses in the area of contact. A frictional damping of the vibratory motion of the combustor liner is thus obtained.

Figures 10, 11, 12, 13:
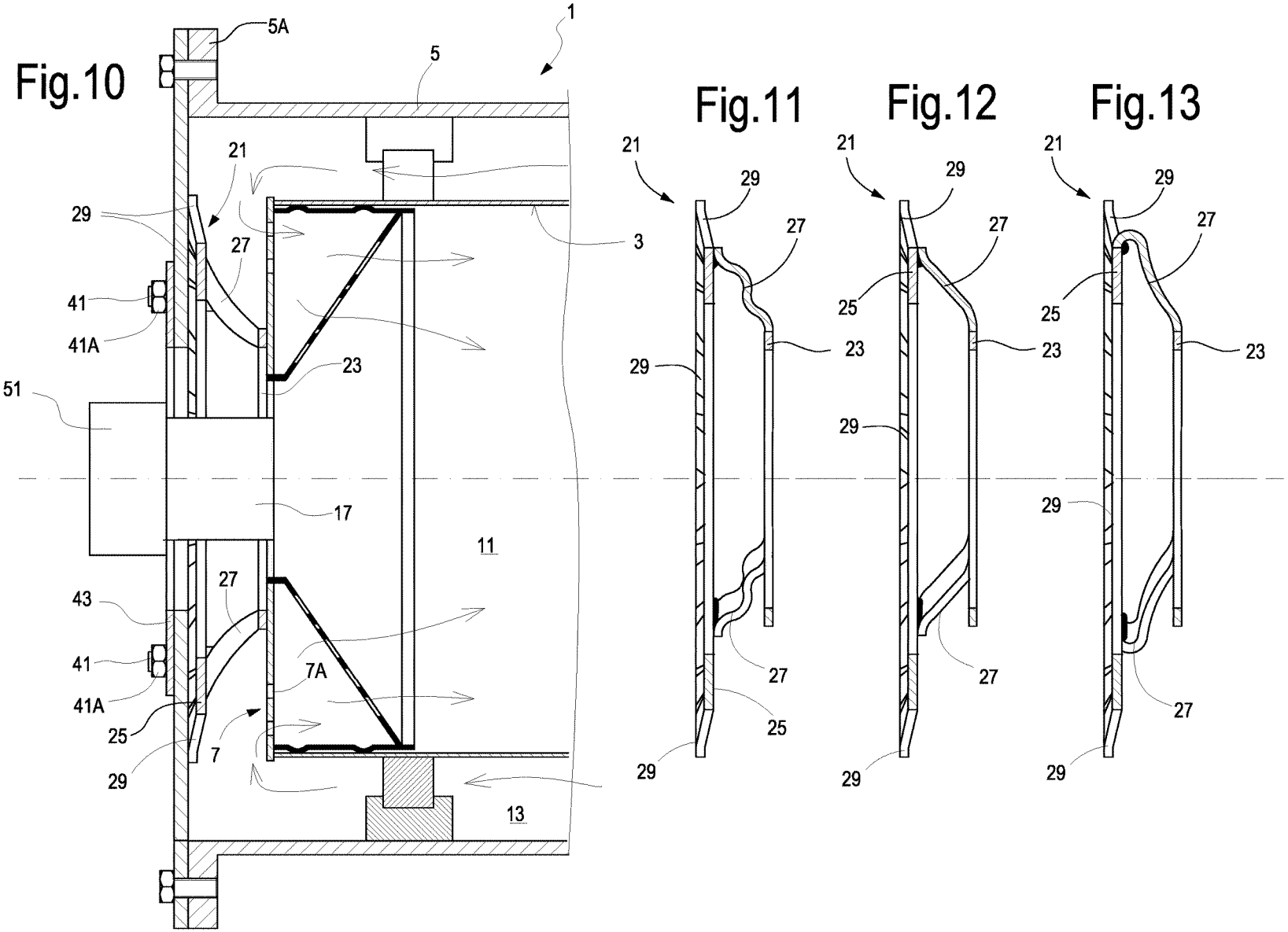
FIG. 10 illustrates an enlargement of FIG. 6.
FIGS. 11, 12, 13 and 14 illustrate further embodiments of the retainer according to the present disclosure.

A flexible connection of the combustor liner 3 to the end cover 18 is thus obtained, which helps in having a desired dynamic response of the combustor when excited by a forces generated e.g. by pressure waves due to the combustion process. This reduces vibration and wear. A frictional damping effect contributes to dissipate energy and further reduce vibration and displacements between components of the combustor assembly. Several modifications and improvements can be included in the above described embodiment. For instance, resilient members 27 of different shapes can be used, e.g. in order to optimize the flexural resilient deformability thereof. FIG. 11 illustrates a retainer 21 comprised of a first ring element 23 and a second ring element 25 which are mutually connected by means of resilient members 27 having a wavy form, which improves the flexural deformability of the resilient members 27. Resilient leaves 29 can be integrally formed with the second ring element 25 and/or first ring element 23, or soldered thereto.

FIGS. 12 and 13 illustrate further embodiments of retainer 21, with differently shaped resilient members 27.

The resilient members 27 of FIGS. 7 to 13 can have a cross-section designed to improve the aerodynamic behavior thereof. For instance, the cross-section of the resilient members 27 can be such as to reduce air friction and head losses in the air flow entering the combustion chamber 11 through the apertures or holes 7A.

Figure 14:
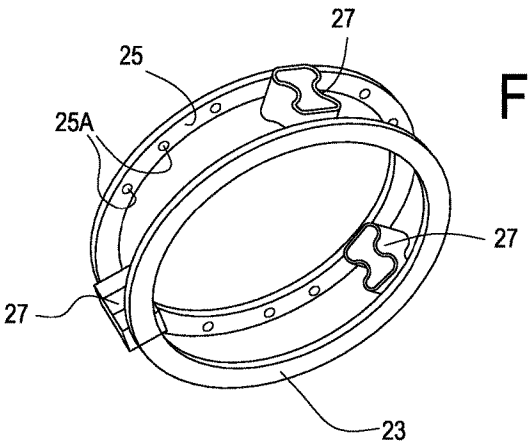

FIG. 14 illustrates a further embodiment of a retainer 21 according to the present disclosure. The retainer 21 of FIG. 14 comprises a first ring element 23, intended for connection to the metering plate 7 of the combustor liner 3, and a second ring element 25, intended for connection to the end cover 18. A first set of resilient members 27 connect the first and second ring elements 23, 25 to one another. In this embodiment the resilient members 27 are shaped as springs each comprised of a substantially loop-shaped body made of a resiliently deformable metal sheet or the like. The second ring element 25 can be provided with flexurally deformable, radially projecting leaves similar to leaves 29 of FIGS. 9-13 (not shown in FIG. 14).

Figure 15:
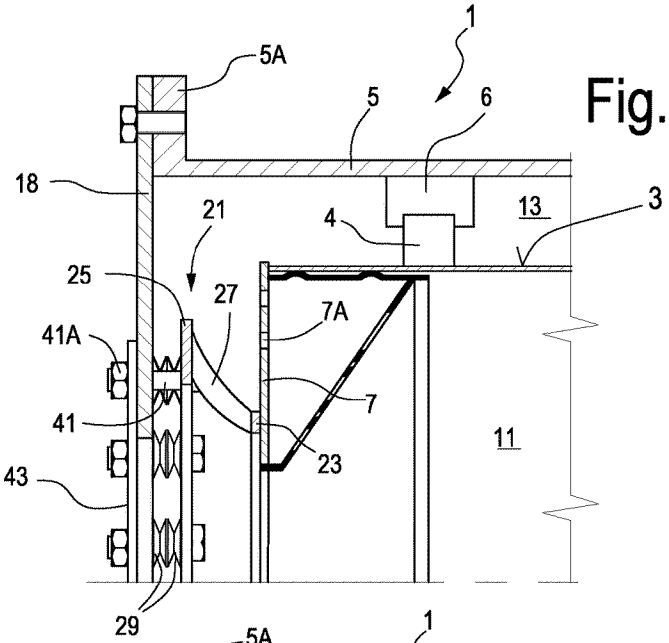
FIGS. 15 and 16 illustrate sectional views of further embodiments of a retainer according to the present disclosure.

FIG. 15 illustrates a partial sectional view of a further embodiment of a combustor according to the subject matter disclosed herein. The same reference numbers designate the same or corresponding parts as in FIGS. 6 to 10. In the embodiment of FIG. 15 the first ring element 23 is connected, e.g. welded, soldered, bolted or screwed to the metering plate 7, while the first and second ring elements 23, 25 are connected to one another by connector elements 27. These latter can be rigid or flexurally deformable to form a first set of resilient members. The second ring element 25 is constrained to the end cover 18 by means of a plurality of nut and bolt arrangements 41A, 41. In order to impart a resilient characteristic to the connection between the metering plate 7 and the end cover 18, one or more Belleville washers or springs 47 are arranged around each bolt 41. The pack of Belleville springs 47 arranged around each bolt 41 form a respective one of a set of resilient members. Upon connection of the retainer 21 and relevant combustor liner 3 to the end cover 18, the resilient members formed by the Belleville springs 47 are pre-loaded by screwing nuts 41A on bolts 41. Friction contact is established between the pre-loaded Belleville washers 47 and the inner surface of the end cover 18, resulting in a frictional damping of vibrations of the combustor components.

Figure 17:
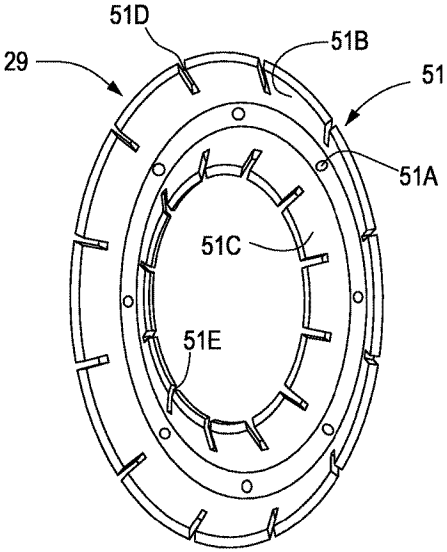
Figure 16:
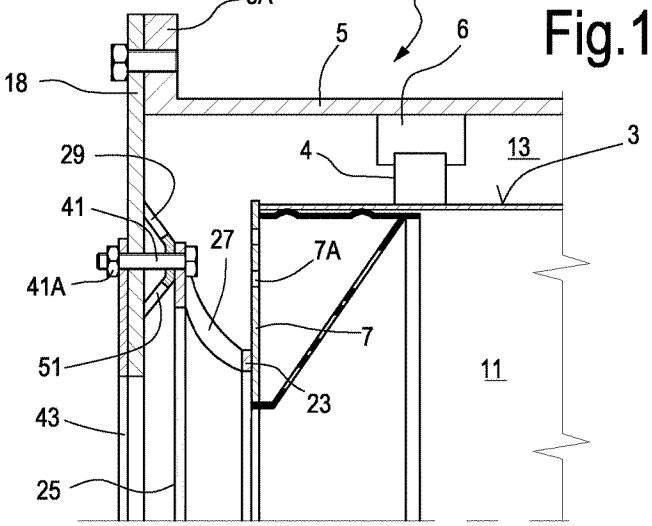

FIGS. 16 and 17 illustrate a further embodiment of the retainer 21 connecting the combustor liner 3 to the end cover 18. The same reference numbers indicate the same parts as in the previously described figures. In FIGS. 16 and 17 the first ring element 23 is welded or otherwise connected to the metering plate 7 of the combustor liner 7 on one side and to the second ring element 25 on the other. Connection between first and second ring elements 25 can be provided by a first set of resilient members 27, or by rigid connector elements, in the form of struts or the like.

The second ring element 25 is constrained to the end cover 18 by means of a plurality of bolts 41 and relevant nuts 41A. As in the previously described embodiments, the bolts 41 can be introduced in through holes formed in the second ring element 25, or else can be soldered or welded to the second ring element 25. Elasticity between the retainer 21 and the end cover 18 is provided by a resilient member 51 which can have a generally annular shape and an approximately V-shaped cross-section (see FIG. 16). The resilient annular member 51 can have a plurality of through holes 51A for insertion of bolts 41. The annular member 51 can further be comprised of a first, external conical portion 51B and a second, internal conical portion 51C. In some embodiments the resilient annular member 51 can be made of a resilient metal sheet. According to some embodiments, in order to make the annular member 51 more elastically yieldable, a plurality of notches or slots 51D, 51E can be provided along the outer edge and/or the inner edge thereof.

The annular member 51 is located between the second ring element 25 and the inner surface of the end cover 18. The bolts 41 extend through holes 51A of the resilient annular member 51 and connect retainer 21 and end cover 18 to one another. By screwing the nuts 41A on bolts 41, the resilient annular member 51 can be resiliently pre-loaded, this resulting in friction between the annular member 51 and the inner surface of end cover 18, for frictional damping purposes.

Figure 18:
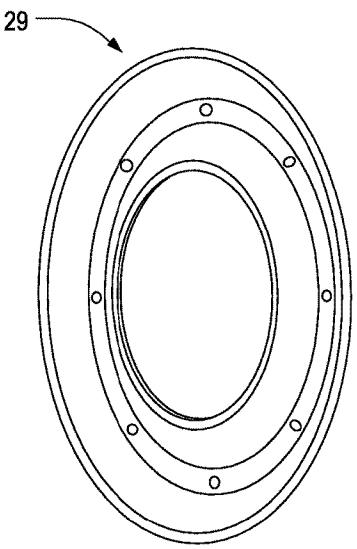
FIGS. 17 and 18 illustrate axonometric views of elastic members of a retainer according to FIG. 16.

In some modified embodiments the resilient annular member 51 can be devoid of slots or notches 51D, 51E, as shown in FIG. 18.

Figure 20:
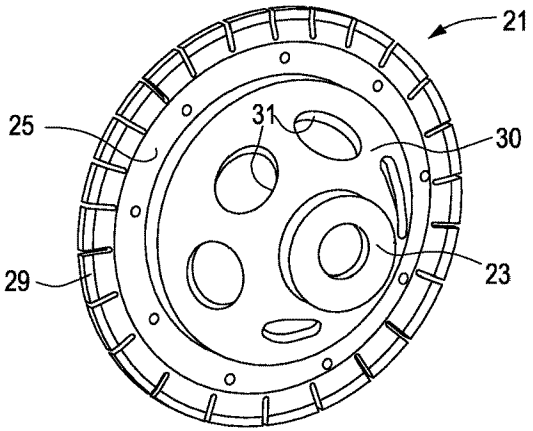
FIG. 20 illustrates an axonometric view of the retainer of FIG. 19.
Figure 19:
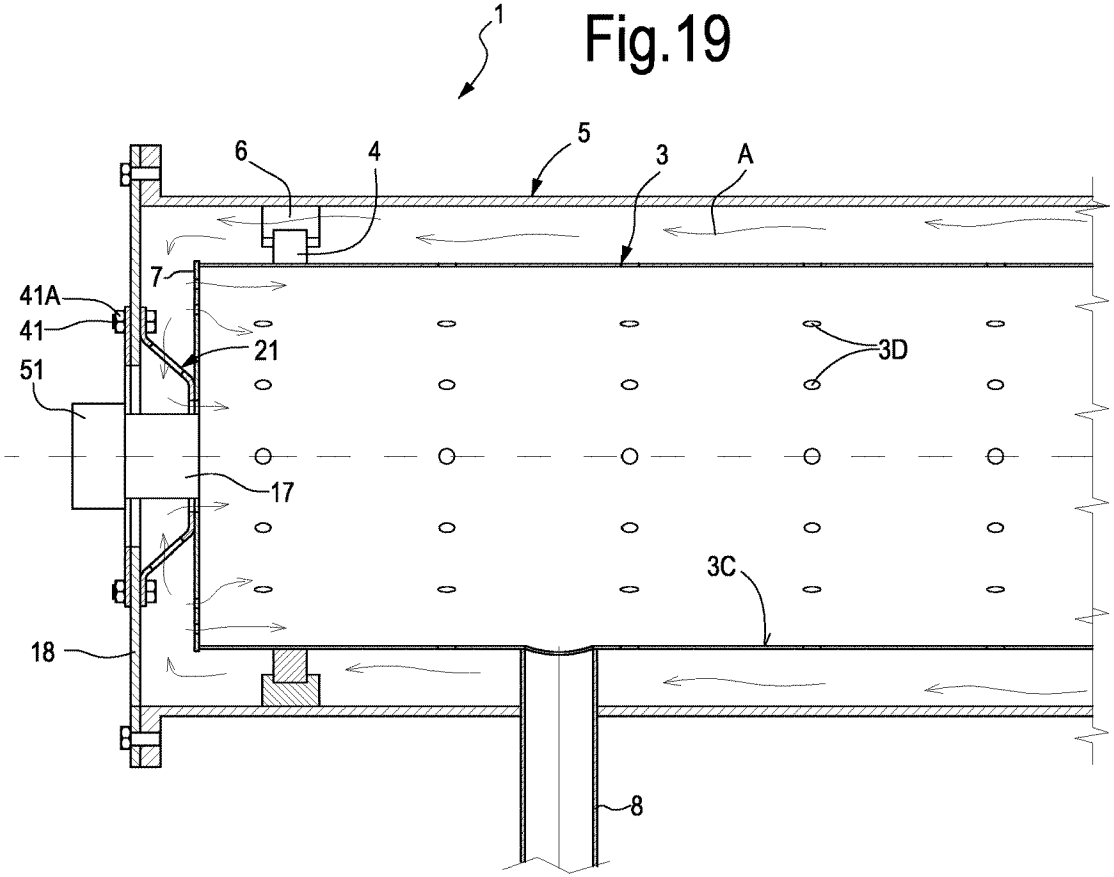
FIG. 19 illustrates a sectional view of a further embodiment of a combustor according to the present disclosure.

FIG. 19 illustrate a schematic sectional view of a further exemplary embodiment of a combustor according to the present disclosure. The same reference numbers indicate same or equivalent components as shown in FIGS. 2-18. FIG. 20 illustrate an axonometric view of the retainer 21 of FIG. 19. In this embodiment the retainer 21 is formed as a single integral component, e.g. manufactured by drawing and cutting a metal sheet. The retainer 21 is provided with a first ring element 23 configured for connection to the metering plate 7 of the combustor liner 3. The second ring element 25 is further formed by retainer 21, for connection to the end cover 18. The second ring element 25 can be provided with outwardly projecting, in an embodiment, resilient leaves 29. In assembled condition the leaves 29 are pre-loaded against the end cover 18, providing a frictional damping effect. The first ring element 23 and the second ring element 25 are connected to one another by an apertured wall 30 forming a connector arrangement between the two ring elements 23, 25. Apertures 31 are provided in wall 30, wherethrough compressed air flows towards the metering holes 7A.

The retainer 21 arranged between the metering plate 7 and the end cover 18, provides a better accessibility to the annular volume defined between combustor casing 5 and combustor liner 3, such that e.g. mounting of the cross-fire tubes 8 easier. Moreover, the configuration and position of the retainer 21 improves the air flow towards and through the metering plate 7 and relevant metering holes 7A, with simple shapes of the retainer. The resiliency of the retainer and the frictional damping effect provided by the resilient elements contribute to reduction of vibration and mutual displacement between combustor components at the contacting interfaces therebetween, thus contributing to reduction of wear.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A combustor for a gas turbine comprising:

a combustor liner having a first end, a second end and a side wall extending between the first end and the second end;

a metering plate attached to the first end of the combustor liner;

a combustor casing at least partially surrounding the combustor liner;

an end cover connected to the combustor casing; and a retainer, connecting the combustor liner to the combustor casing, arranged between the metering plate and the end cover and attached to the metering plate and to the end cover, the retainer comprising a first ring element constrained to the metering plate and a second ring element arranged between the first ring element and the end cover, and wherein an elastic arrangement is located between the second ring element and the end cover, the elastic arrangement includes resiliently deformable and radially projecting members, in surface contact with the end cover, wherein the resiliently deformable and radially projecting members are circumferentially spaced relative about a perimeter of the second ring element with a gap defined between at least two adjacent projecting members.

2. The combustor of claim 1, wherein an additional elastic arrangement is located between the first ring element and the second ring element, at least one of the elastic arrangement and the additional elastic arrangement is pre-loaded and provides a frictional damping action.

3. The combustor of claim 1, wherein the second elastic arrangement is in surface contact with the end cover.

4. The combustor of claim 1, wherein the second ring element is provided with resiliently deformable and radially projecting members, in surface contact with the end cover.

5. The combustor of claim 4, wherein the second ring element defines holes configured to receive fasteners therethrough to secure the second ring element to the end cover.

6. The combustor of claim 4, wherein the gap is defined between each pair of adjacent resiliently deformable and radially projecting members.

7. The combustor of claim 1, wherein the metering plate is provided with a plurality of metering holes extending therethrough, and wherein the first ring element is attached to a surface portion of the metering plate devoid of metering holes.

8. A method for mounting a combustor liner in a combustor casing of a gas turbine combustor, the method comprising:

attaching a metering plate of a combustor liner to a retainer, the retainer comprising a first ring element constrained to the metering plate, a second ring element arranged between the first ring element and an end cover attachable to an end of the combustor casing, and an elastic arrangement in surface contact with the end cover, the elastic arrangement includes resiliently deformable and radially projecting members, in surface contact with the end cover, wherein the resiliently deformable and radially projecting members are circumferentially spaced relative about a perimeter of the second ring element with a gap defined between at least two adjacent projecting members;

attaching the retainer to the end cover;

introducing the combustor liner into the combustor casing; and connecting the end cover to the combustor casing such that the combustor liner is supported approximately concentrically in the combustor casing.

9. The method of claim 8, wherein an additional elastic arrangement is located between the first ring element and the second ring element, and the method further comprising resiliently pre-loading at least one of the elastic arrangement and the additional elastic arrangement.

10. The method of claim 8, further comprising pre-loading the elastic arrangement against the end cover, thus generating a frictional force therebetween.

11. The method of claim 8, further comprising providing a vibration-damping arrangement between the metering plate and the end cover.

12. The method of claim 8, further comprising locating the elastic arrangement at least between the second ring element and the end cover.

* * * * *